United States Patent [19]

Suzuki

[11] Patent Number: 4,523,556

[45] Date of Patent: Jun. 18, 1985

[54] FOUR-STROKE INTERNAL COMBUSTION ENGINE FOR OUTBOARD MOTORS

[75] Inventor: Masayuki Suzuki, Hamamatsu, Japan

[73] Assignee: Sanshin Kogyo Kabushiki Kaisha, Japan

[21] Appl. No.: 630,978

[22] Filed: Jul. 16, 1984

[30] Foreign Application Priority Data

Jul. 18, 1983 [JP] Japan ..... 58-129349

[51] Int. Cl.[3] ..... F01M 1/00

[52] U.S. Cl. ..... 123/196 W; 123/196 R; 123/196 S; 184/6.18; 440/88

[58] Field of Search ..... 123/195 C, 195 P, 196 R, 123/196 W, 196 S; 184/6.18; 440/53, 88

[56] References Cited

U.S. PATENT DOCUMENTS 3,799,291 3/1974 Becker ..... 184/6.18

4,461,250 7/1984 Mohr ..... 440/88

*Primary Examiner*—E. Rollins Cross

*Attorney, Agent, or Firm*—Ernest A. Beutler

[57] ABSTRACT

Two embodiments of lubricating systems for the four cycle engine of an outboard motor, each of which embodies a lubricant sump that is disposed beneath the engine and to which lubricant is returned by gravity. In each embodiment, a buffer volume is provided that receives lubricant when the engine is oriented in other than a desired position so that the oil will flow into this buffer volume rather than being discharged from the sump. The lubricant is returned to the engine from the buffer volume when the engine is again placed in its normal orientation. In one embodiment of the invention, the buffer volume is provided by the camshaft chamber of the engine.

9 Claims, 5 Drawing Figures

FOUR-STROKE INTERNAL COMBUSTION ENGINE FOR OUTBOARD MOTORS

BACKGROUND OF THE INVENTION

This invention relates to a four-stroke internal combustion engine for outboard motors and more particularly to an improved lubricating system for the four-stroke engine of an outboard motor.

Although most outboard motors operate on the two-stroke principle, there are some advantages to employing four-stroke engines in outboard motors. In connection with the use of an engine operating on the four-stroke principle, it is necessary to provide an oil reservoir in which the lubricating oil for the engine is contained. Since the motor is normally positioned with the crankshaft of the engine extending vertically, it has been the common practice to provide an oil reservoir for containing the lubricant at a level below the engine and below its crankcase. Oil may drain into this oil reservoir from the crankcase or from the camshaft chamber of the engine by gravity. In order to insure this gravity return, it is, of course, necessary to provide an opening through which the lubricant may return to the reservoir. However, even though the outboard motor is normally operated in a vertical position, there are many times when the motor is disposed horizontally, such as when being transported. When being transported, it is desirable to lay the motor on its forward face so that the lubricant cannot flow back from the reservoir into the engine. Such reverse flow could cause the lubricant to enter the exhaust system and contaminate the water or environment when the engine was next placed in an upright position. Although it has been proposed to prevent such reverse flow by using small openings and by carefully controlling the position of the opening, this expedient can retard the rate of flow of lubricant back to the reservoir during normal operating conditions and cause problems.

It is, therefore, a principal object of this invention to provide an improved lubricating system for an outboard motor.

It is a further object of this invention to provide an oil reservoir arrangement for the internal combustion engine of an outboard motor that prevents spillage of the lubricant from the reservoir when the engine is oriented in an abnormal condition.

SUMMARY OF THE INVENTION

This invention is adapted to be embodied in a lubricating system for an outboard motor or the like having a power head containing an internal combustion engine, a lubricant sump positioned below the engine and adapted to contain lubricant from the engine and a drain opening communicating the sump with the lubricating system of the engine for return of lubricant from the engine lubricating system to the sump by gravity when the outboard motor is operating in a normal, vertical position. In accordance with the invention, a buffer volume is provided for receiving lubricant from the lubricant sump when the engine is disposed in a non-vertical position for flow of lubricant from the lubricant sump to the buffer volume.

DETAILED DESCRIPTION OF THE PREFERRED EMBODIMENTS

Figure 1:
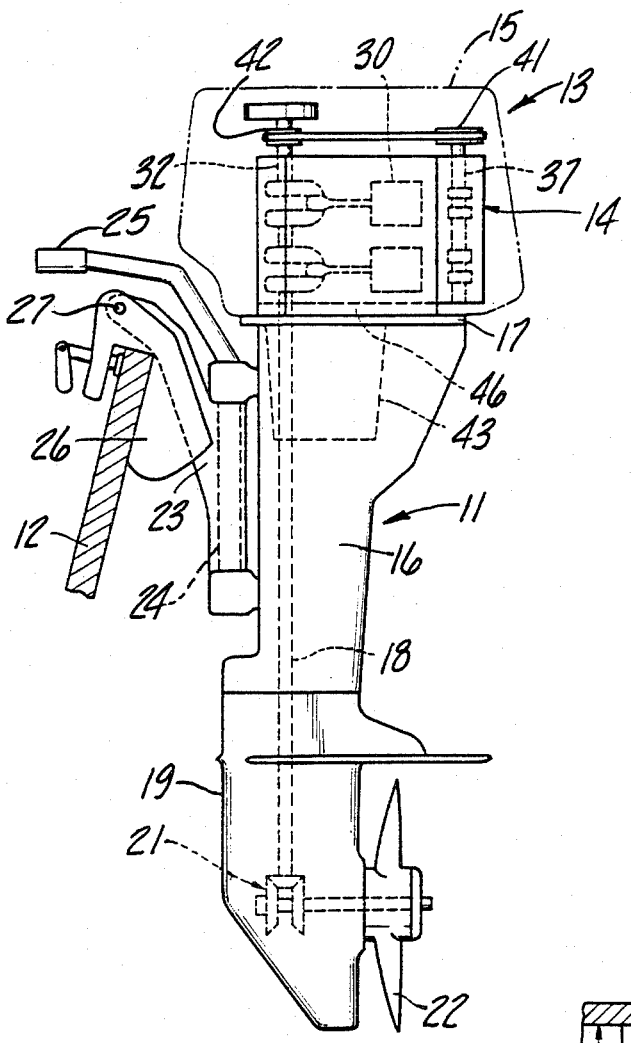
FIG. 1 is a side elevational view of an outboard motor having a lubricating system constructed in accordance with an embodiment of the invention.

Referring first to FIG. 1, an outboard motor constructed in accordance with an embodiment of this invention is identified generally by the reference numeral 11 and is shown as being mounted in its normal operating position on the transom 12 of an associated watercraft, which is shown only partially. The outboard motor 11 includes a power head, indicated generally by the reference numeral 13 and which includes an internal combustion engine, indicated generally by the reference numeral 14, and a surrounding protective cowling, which is shown in phantom and identified by the reference numeral 15.

A drive shaft housing 16 is connected to the power head 13 by means including a spacer plate 17. A drive shaft 18 is rotatably journaled in the drive shaft housing 16 in a suitable manner and it is driven by the output shaft of the engine 14, in a manner to be described. The drive shaft 18 extends through a lower unit 19 in which a forward, neutral, reverse transmission 21 of any known type is provided for selectively driving a propeller 22 so as to propel the associated watercraft.

A swivel bracket 23 rotatably journals a steering shaft 24 that is fixed to the drive shaft housing 16 for steering the outboard motor 11 about a generally vertically extending steering axis under the control of a tiller 25. The swivel bracket 23 is, in turn, pivotally connected to a clamping bracket 26 by means of horizontally extending tilt pin 27. This arrangement permits tilting movement of the outboard motor 11 relative to the transom 12, to which the clamping bracket 26 is affixed in a known manner.

The construction of the outboard motor 11 as thus far described may be considered to be conventional and, for that reason, the detailed construction of the components already described has been eliminated. Referring now additionally to the remaining figures, the engine 14 is constructed to operate on the four-stroke principle and is comprised of a cylinder block 28 in which a pair of vertically spaced, horizontally extending cylinder bores 29 are formed. Pistons 30 are reciprocally supported in the cylinder bores 29 and are connected by means of connecting rods 31 to a crankshaft 32 for driving it in a known manner. The crankshaft 32 is, as is typical with outboard motors, supported for rotation about a vertically extending axis within a crankcase 33 which forms a crankcase chamber 34. The crankshaft 32 is rotatably coupled to the drive shaft 18 by means of a suitable coupling mechanism.

A cylinder head 35 is affixed to the cylinder block 28 in a known manner and defines recesses 36 which function with the pistons 30 and cylinder bores 29 to form the combustion chambers. Flow to and from the combustion chambers 36 is controlled by means of intake and exhaust valves (not shown) that are operated by means of an overhead mounted camshaft 37 which is supported for rotation about a vertically extending axis parallel to the axis of the rotation of the crankshaft 32. The camshaft 37 is contained within a cam chamber 38 formed by the cylinder head 35 and a closure plate 39 which is affixed to the cylinder head 35 in a known manner. The chamshaft 37 is driven by means of a blet that is trained over a pulley 41 affixed to the camshaft 37 and a pulley 42 that is affixed to the crankshaft 32.

The engine 14 is provided with a lubricating system that includes a reservoir or sump 43 that is affixed to the spacer plate 17 and which depends below the power head 13 into the drive shaft housing 16. Lubricant contained within the sump 43 is drawn from an engine driven lubricant pump (not shown) for delivery to the various components of the engine to be lubricated such as the main and connecting rod bearings of the crankshaft 32, the supporting bearings of the camshaft 33 and the other components normally lubricated. The details and construction by which the lubricant is delivered to the lubricated components forms no part of this invention and, for that reason, has not been described.

Normally, the lubricant is returned to the sump 43 by gravity and an opening 44 is provided in the spacer plate 17 and defined by a baffle 45 so as to permit such gravity return. However, it should be readily apparent that when the outboard motor 11 is oriented other than in its normal operative vertical position, the level of the lubricant in the sump 43 will reach the baffled opening 44 and lubricant can flow back into the engine lubricating system. With conventional engines, such return flow could permit oil to enter the exhaust system of the engine so that it would be discharged into the water when the motor 11 were next utilized. Of course, the opening 44 is positioned so as to prevent such normal return flow even when the engine is stored in a horizontal position. However, the engine must be stored horizontally in a specific orientation, for example, with the cylinder head 35 disposed below the cyliinder block 28 to achieve this effect. If the engine falls over from this orientation, however, the lubricant could return back to the engine from the sump 43.

In order to prevent such return flow to the engine, a buffer chamber or volume 46 is provided. This buffer chamber or volume is defined, in this embodiment, by means of a space formed between a lower surface of the engine 14 and the upper surface of the spacer plate 17. This lower surface of the engine communicates with the buffer volume 46 by means of an opening 47 defined by a baffled portion 48 so as to permit flow. In the illustrated embodiment, the opening 47 is formed immediately under the crankcase chamber 34 and substantially in alignment with the spacer plate opening 44.

During normal engine operation with the outboard motor 11 positioned vertically, lubricant that has been delivered to the various components of the engine 14 which are lubricated will return in a suitable manner to the crankcase chamber 34. This lubricant may then flow through the opening 47 into the buffer volume 46. However, since the opening 47 is positioned directly and vertically above the spacer plate opening 44, no lubricant will accumulate in the buffer volume 46. Lubricant will, however, merely flow by gravity directly into the sump 43.

Figure 4:
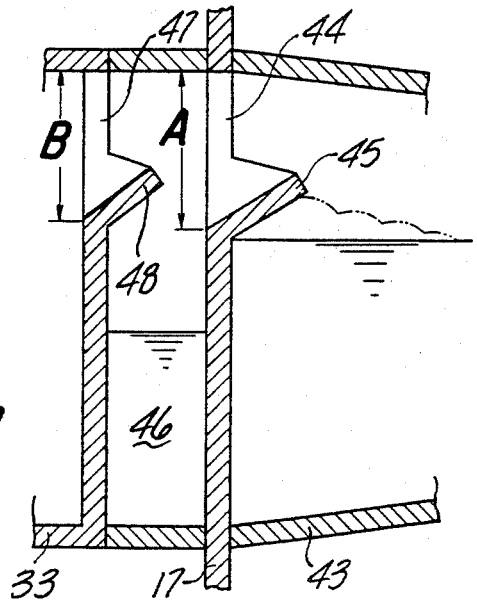
FIG. 4 is an enlarged cross-sectional view showing the operation of the lubricant system to prevent the discharge of lubricant when the outboard motor is oriented in an abnormal condition.
Figure 2:
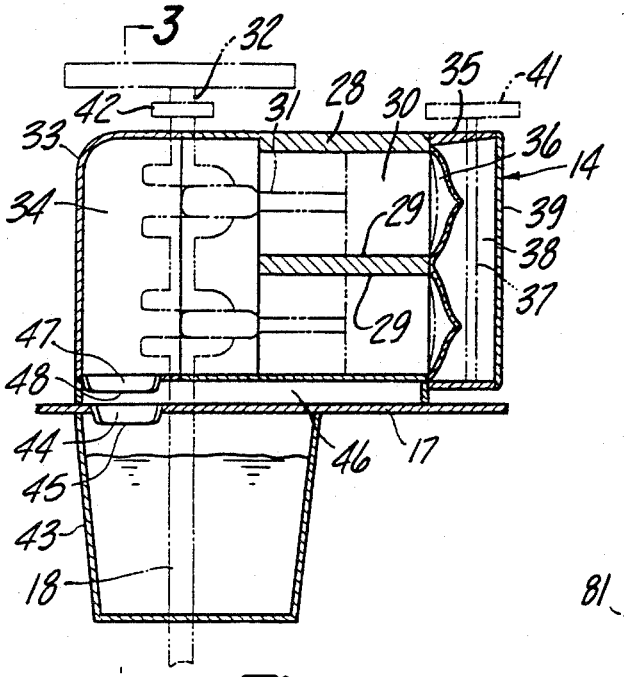
FIG. 2 is an enlarged cross-sectional view showing the engine and its lubricating system as taken along a generally vertically extending plane.
Figure 3:
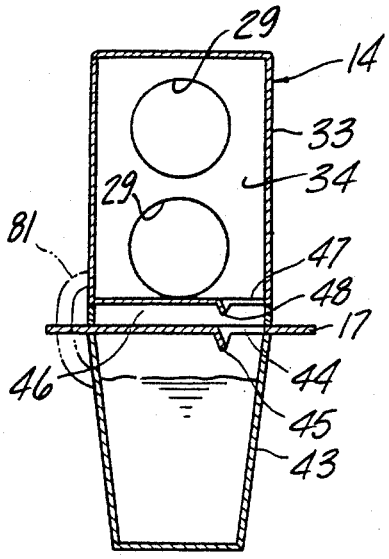
FIG. 3 is a cross-sectional view taken along the line 3—3 of FIG. 2.

When the engine is not in use and being transported, it is normally positioned in a horizontal direction with the cylinder head 35 positioned beneath the cylinder block 28, as aforenoted. In this relationship, the liquid or lubricant in the sump 43 will assume a different orientation but will still lie below the baffled opening 44 in the spacer plate 17. If, however, the engine falls over on its left side as viewed in FIG. 3, the lubricant will assume the position shown in FIG. 4. Lubricant may then reach a level so as to reach the opening 44 which is spaced from what will now be the upper wall of the sump 43 by the distance "A". However, before this lubricant can flow back into the engine, it must reach the opening 47. Thus, lubricant will now accumulate in the buffer volume 46 to a level as shown in FIG. 4. It should be noted that the opening 47 is spaced above the upper level of the sump 43 by a distance "B" which is less than the distance "A" so that a substantial volume of buffer capacity will be provided. Hence, even though the engine may fall over from its preferred orientation, the lubricant will not flow back to the engine for possible entry into its exhaust system but will merely accumulate in the buffer volume 46.

When the outboard motor 11 is again reoriented in its normal vertical position, the lubricant from the buffer volume 46 will return to the sump 43 through the opening 45.

Figure 5:
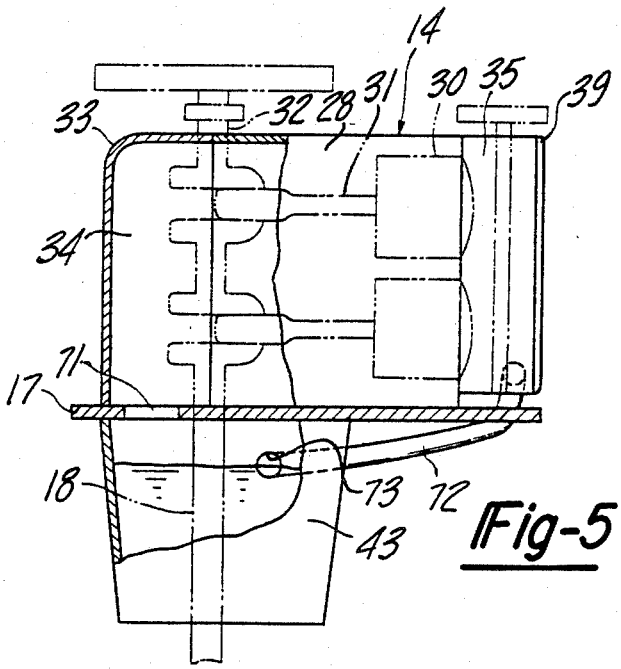
FIG. 5 is a cross-sectional view, in part similar to FIG. 2, showing a further embodiment of the invention.

Another embodiment of the invention is shown in FIG. 5. In this embodiment, which is generally similar to the previously described embodiment, the crankcase 34 communicates with the sump 43 through an opening 71 formed in the spacer plate 17. Hence, in this embodiment, there is no buffer chamber disposed directly between the crankcase chamber 34 and the sump 43. However, a conduit 72 extends from an opening 73 formed in a wall of the sump 43 to the camshaft chamber 38. The opening 73 is spaced from the opening 71 so that if the motor falls over on its side, lubricant will first flow into the camshaft chamber 38 so that it acts as a buffer volume. When the engine is again placed in its normal upright condition, this oil will flow back into the sump 43 through the conduit 72.

It should be readily apparent that each embodiment of the invention provides a buffer volume into which lubricant will flow when the engine is oriented other than in its desired position. The lubricant from this buffer volume may conveniently flow back into the sump when the engine is placed next in an upright condition. It should be understood that the embodiment of FIGS. 1 through 4 may be modified so as to employ a number of buffer volumes that are interposed between the crankcase 34 and the sump 43 through the provision of additional baffle plates. Alternatively, both the use of the camshaft chamber and additional buffer volumes may be employed by combining the constructions as shown in FIGS. 1 through 4 and FIG. 5. Such a possible application is shown by the phantom line conduit 81 in FIG. 3 which shows the use of the combined buffer volume 46 and the use of the camshaft chamber 38 as a buffer volume. In addition to these modifications, various other changes and modifications may be made without departing from the spirit and scope of the invention, as defined by the appended claims.

I claim:

1. In a lubricating system for an outboard motor or the like having a power head containing an internal combustion engine, a lubricant sump positioned below said engine and adapted to contain lubricant for said engine, and a drain opening communicating said sump with the lubricating system of the engine for return of lubricant from said engine lubricating system to said sump by gravity when said outboard motor is operating in a normal, vertical position, the improvement comprising means defining a buffer volume for receiving lubricant from said lubricant sump when said engine is disposed in a non-vertical position for flow of lubricant from said lubricant sump to said buffer volume for return to said lubricant sump from said buffer volume when the engine is disposed in its normal vertical position.

2. In a lubricating system as set forth in claim 1 wherein the buffer volume is defined by components of the engine that define a cavity for receiving lubricant.

3. In a lubricating system as set forth in claim 2 wherein the lubricant is returned from the buffer volume to the lubricant sump through a conduit other than the drain opening.

4. In a lubricating system as set forth in claim 3 wherein the conduit further returns lubricant from components lubricated within the cavity to the lubricant sump during normal operation.

5. In a lubricating system as set forth in claim 2 wherein the component of the engine defining the buffer volume comprises a camshaft chamber in which a camshaft is rotatably supported.

6. In a lubricating system as set forth in claim 5 wherein the lubricant is returned to the sump from the camshaft chamber through a separate return conduit.

7. In a lubricating system as set forth in claim 1 wherein the buffer volume is defined by a volume extending across the upper end of the sump and further including a baffled opening communicating said volume with the crankcase of the engine.

8. In a lubricating system as set forth in claim 7 wherein the baffled opening and the drain opening are disposed in substantial vertical alignment.

9. In a lubricating system as set forth in claim 8 wherein the drain opening and the baffled opening are spaced different distances from a sidewall of the sump.

* * * * *